United States Patent [19]

Gutgsell

[11] Patent Number: 4,789,122

[45] Date of Patent: Dec. 6, 1988

[54] TABLE BASE CONSTRUCTION

[75] Inventor: David R. Gutgsell, Jasper, Ind.

[73] Assignee: Ditto Sales, Inc., Jasper, Ind.

[21] Appl. No.: 79,248

[22] Filed: Jul. 29, 1987

[51] Int. Cl.[4] ..... A47B 91/00

[52] U.S. Cl. ..... 248/188.7; 108/150; 248/163.2; 403/175

[58] Field of Search ..... 248/188.7, 163.1, 163.2; 403/175, 178; D6/498; 108/150

[56] References Cited

U.S. PATENT DOCUMENTS

| | | | |
|---|---|---|---|
| D. 273,549 | 4/1984 | Petitt | D6/498 |
| 2,918,243 | 12/1959 | Johnson et al. | 248/188.7 |
| 3,185,423 | 5/1965 | Jones, III | 108/150 X |
| 3,479,973 | 11/1969 | Bartlett et al. | 248/188.7 X |
| 3,908,946 | 9/1975 | George et al. | 248/188.7 |
| 3,994,461 | 11/1976 | Dorantes | 248/188.7 |
| 4,448,378 | 5/1984 | Binfare | 248/188.7 |
| 4,520,981 | 6/1985 | Harrigan | 248/188.7 X |
| 4,566,661 | 1/1986 | Mestler | 248/188.7 X |
| 4,653,710 | 3/1987 | Dickison | 248/188.7 |

*Primary Examiner*—Ramon O. Ramirez
*Attorney, Agent, or Firm*—Woodard, Emhardt, Naughton, Moriarty & McNett

[57] ABSTRACT

A table base construction includes a plurality of leg assemblies, a central attachment assembly integrating each of the leg assemblies, a vertical standard assembly mounted on the central attachment assembly, and a support plate assembly mounted on the vertical standard assembly. The leg assemblies include a plurality of elongated strips that are interconnected by machine screws in an overlayed construction.

The central attachment assembly centrally connects each of the leg at its inner end in juxtaposed radial relation. The central attachment assembly includes a column washer and an attachment washer. The legs are affixed at their inner ends to the attachment washer by attachment screws extending through the aligned bores in the leg assemblies and the column washer and engaged in threaded bores in the attachment washer. When the leg assemblies are so connected, free edges at the inner ends of the leg assemblies form a non-circular opening.

The vertical standard assembly includes a hollow column supported between the attachment washer and the support plate assembly. A tension rod is affixed to the support plate assembly and extends through the hollow column. The rod includes a portion having a non-circular outer surface that is complementary to the non-circular opening, to prevent rotation of the support plate assembly bearing a table top relative to the leg assemblies. The rod is threadedly engaged at its end with a nut that is tightened against the leg assemblies to tension the rod.

12 Claims, 3 Drawing Sheets

TABLE BASE CONSTRUCTION

BACKGROUND OF THE INVENTION

This invention relates generally to the field of furniture construction, and more particularly to metal bases for supporting tables and the like.

Table bases in a variety of decorative forms have been fabricated from metallic castings and welded constructions. Casting operations require high volume to be economical, and the resulting product is often heavier than other types of table base construction. Welding operations must generally be followed by additional polishing to smooth the surface and remove the weld marks. For most table base constructions formed from castings or weldings, it is difficult to chrome-plate or paint the various elements of the table base particularly bases that include decorative grooves or channels. These constructions do not lend themselves to custom designing of the table base or the modification of the external appearance for aesthetic purposes by the end user.

In many table base constructions, a central post or bolt is used to support an interface plate for the table top. This post or bolt is then mounted to the table base legs by a nut or other threaded engagement. In table base constructions of this type, the table top is susceptible to being unscrewed from the table base, frequently during normal use of the table. Unwanted disassembly of the top from the base can be thwarted by welding the post to the base and top, or by providing a bolt pattern at each end of the post that is not along the centerline of the post. These options are cumbersome and/or expensive and do not lend themselves to custom designing of the table base for decorative purposes. Furthermore, these table base constructions must generally be marketed and shipped in a pre-assembled condition, rather than in a disassembled condition for easy fabrication by the end user.

SUMMARY OF THE INVENTION

The present invention addresses the shortcomings of prior table base constructions. Briefly stated, the invention contemplates a table base comprising a plurality of leg elements,. each having an inner end and a free edge at the inner end. Means are provided for connecting each of the plurality of leg elements at its inner end in juxtaposed radial relation relative to each. The leg elements are connected such that the free edges of each leg element collectively form a non-circular opening. A vertical standard is also provided for supporting a table top, the standard having a portion extending through the non-circular opening, and having a complementary non-circular outer surface so that the outer surface acts against the free edges forming the non-circular opening to prevent rotation of the vertical standard with respect to the leg elements about vertical axis passing through the non-circular opening.

In one embodiment of the present invention, each of the leg elements includes a number of overlayed elongated strips that are removably interconnected. In another embodiment, the table base construction comprises a vertical standard, including a hollow column, between a base member and a table top mounting plate. The standard also includes a tension and interlocking means for compressing the vertical hollow column between the mounting plate and the base member and for preventing rotation of the mounting plate with respect to the base member. A tension rod is included extending through the hollow column and containing a non-circular interlocking portion.

Among the objects of the embodiments of the present invention is to provide a table base construction that is aesthetically appealing and allows the end user to easily manipulate the decorative scheme of the table base. Another of the objects is to provide a table base construction that can be easily and economically chrome-plated or painted, as desired by the end user. A further object is to provide a table base for supporting a table top, for instance, that it is not susceptible to easy disassembly during ordinary use of the table. Other objects and benefits of the present invention will become apparent from the following description and drawings.

DESCRIPTION OF THE PREFERRED EMBODIMENTS

Figure 1:
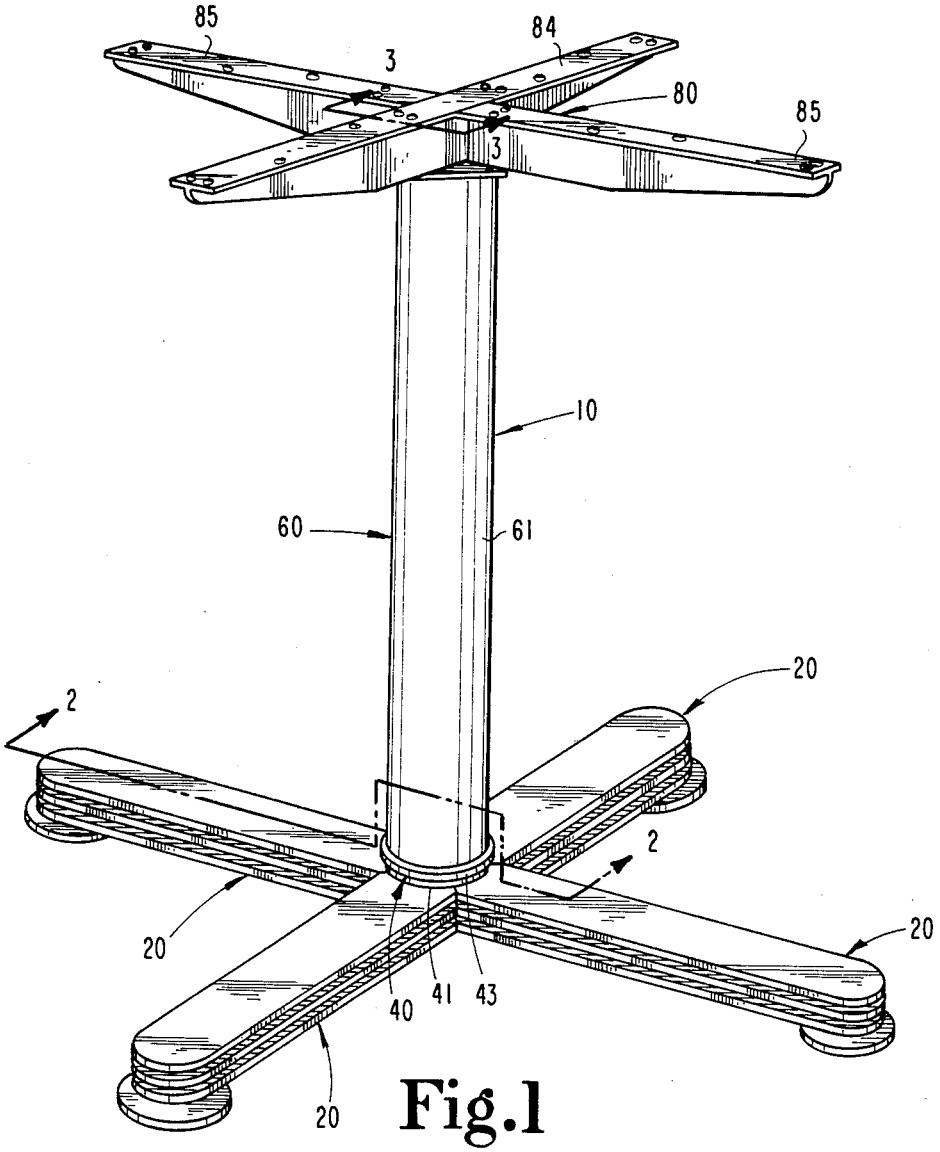
FIG. 1 is a perspective view showing the table base construction of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
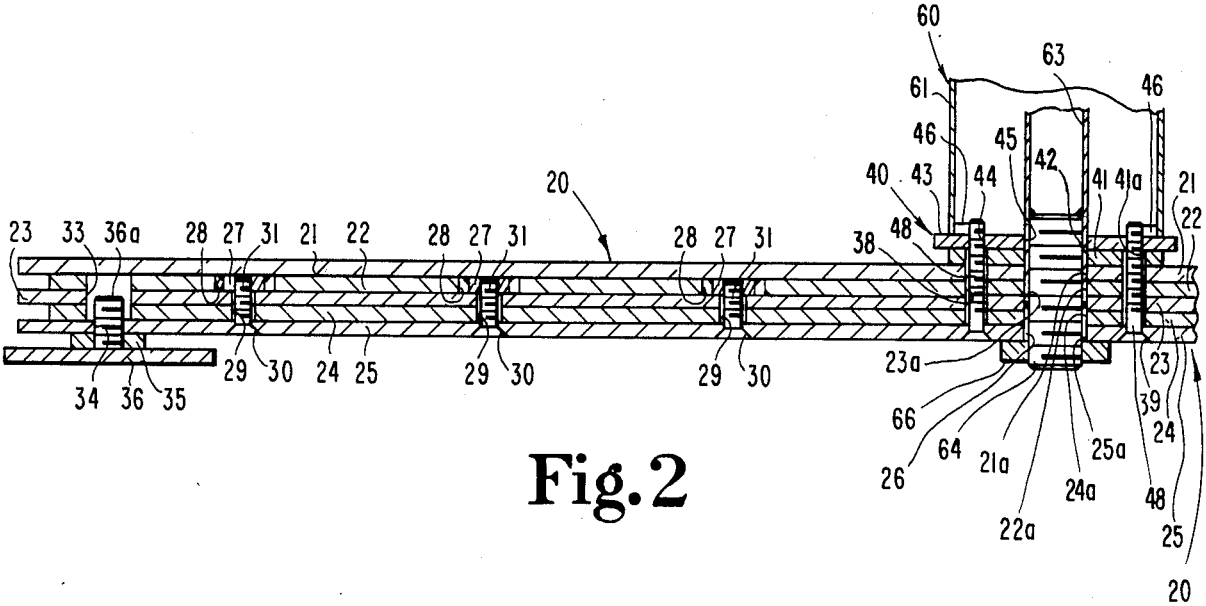
FIG. 2 is a side cross sectional view of the table base of FIG. 1 taken along section line 2—2 and viewed in the direction of the arrows as shown, showing the details of construction for a leg assembly.

A table base assembly 10 includes a plurality of leg assemblies 20, four in number as illustrated in FIG. 1, a central attachment assembly 40 integrating each of the leg assemblies, a vertical standard assembly 60 mounted on the central attachment assembly, and a support plate assembly 80 mounted on the vertical standard assembly. The details of the leg assemblies 20 and the central attachment assembly 40 are described with reference to FIG. 2. In the present embodiment, table base assembly 10 includes four leg assemblies 20, each identical in construction. Leg assembly 20 comprises a plurality of elongated metallic strips 21–25. The strips are interconnected in an overlaying construction, including, in order, top strip 21, upper spacer 22, center strip 23, lower spacer 24, and bottom strip 25. As shown in FIGS. 1 and 2, upper and lower spacers 22 and 24 are narrower and shorter than top, center and bottom strips 21, 23 and 25, respectively. This particular dimensional variation in the metallic strips provides an aesthetically appealing table leg construction. The relative dimensions of the strips 21–25 can be modified to achieve other decorative motifs. In the preferred embodiment, only five metallic strips have been used in the construction of leg assembly 20. It is apparent that fewer or greater numbers of metallic strips can be used in practicing the present invention.

In the preferred embodiment, the metallic strips 21–25 are interconnected by a plurality of machine screws 31 passing through bores in the strips. Top strip 21 includes a plurality of welded nuts 27 at spaced intervals along the length of the strip. Upper spacer 22 includes a plurality of first bores 28 situated to receive welded nuts 27 therein. Metallic strips 23 and 24 include second bores 29 aligned with welded nuts 27 and first bores 28. Bottom strip 25 includes a chamfered bore 30 aligned with the previous bores 28 and 29. Machine screws 31 are inserted through the aligned bores 28, 29 and 30, and threaded into welded nut 27 to interconnect each of the metallic strips 21–25. Since machine screws 31 are inserted through bottom strip 25 they are not visible in the normal use of table base assembly 10.

Each leg assembly 20 is provided with an adjustable glide 36 at the distal end of the leg assembly. Glide 36 includes a threaded post **36*a* extending upward therefrom and engaged in first threaded opening 34 in bottom strip 25. A glide bushing 35 is interposed between bottom strip 25 and glide 36. Threaded post 36*a* extends beyond bottom strip 25 into cavity 33 formed by openings in metallic strips 22–24; thus, glide 36 can be adjusted for height by threading post 36*a* into o out of first threaded opening 34, in order to horizontally stabilize table base assembly 10**.

Each of the leg assemblies 20 are centrally connected in juxtaposed radial relation by central attachment assembly 40. Metallic strips 21–24 include a pair of attachment bores 38 therethrough, and bottom strip 25 includes a pair of second chamfered bores 39 aligned with attachment bores 38. Each of the pairs of bores 38 and 39 are situated adjacent the centrally integrated free edges **21*a*–25*a* of the metallic strips. A column washer 41 is situated over top strips 21 of each of the leg assemblies 20. Column washer 41 includes a plurality of aligned openings 41*a* oriented over each of the pairs of attachment bores 38 in each of the plurality of leg assemblies 20. Central attachment assembly 40 also includes an attachment washer 43 situated atop column washer 41. Attachment washer 43 includes a plurality of second threaded openings 44 aligned with openings 41*a* in column washer 41, and the pairs of bores 38 and 39 in each of the leg assemblies 20. An attachment screw 48 is inserted through each second chamfered bore 39, attachment bore 38, and aligned opening 41*a*, and threaded into each second threaded opening 44 in attachment washer 43**.

Figure 4:
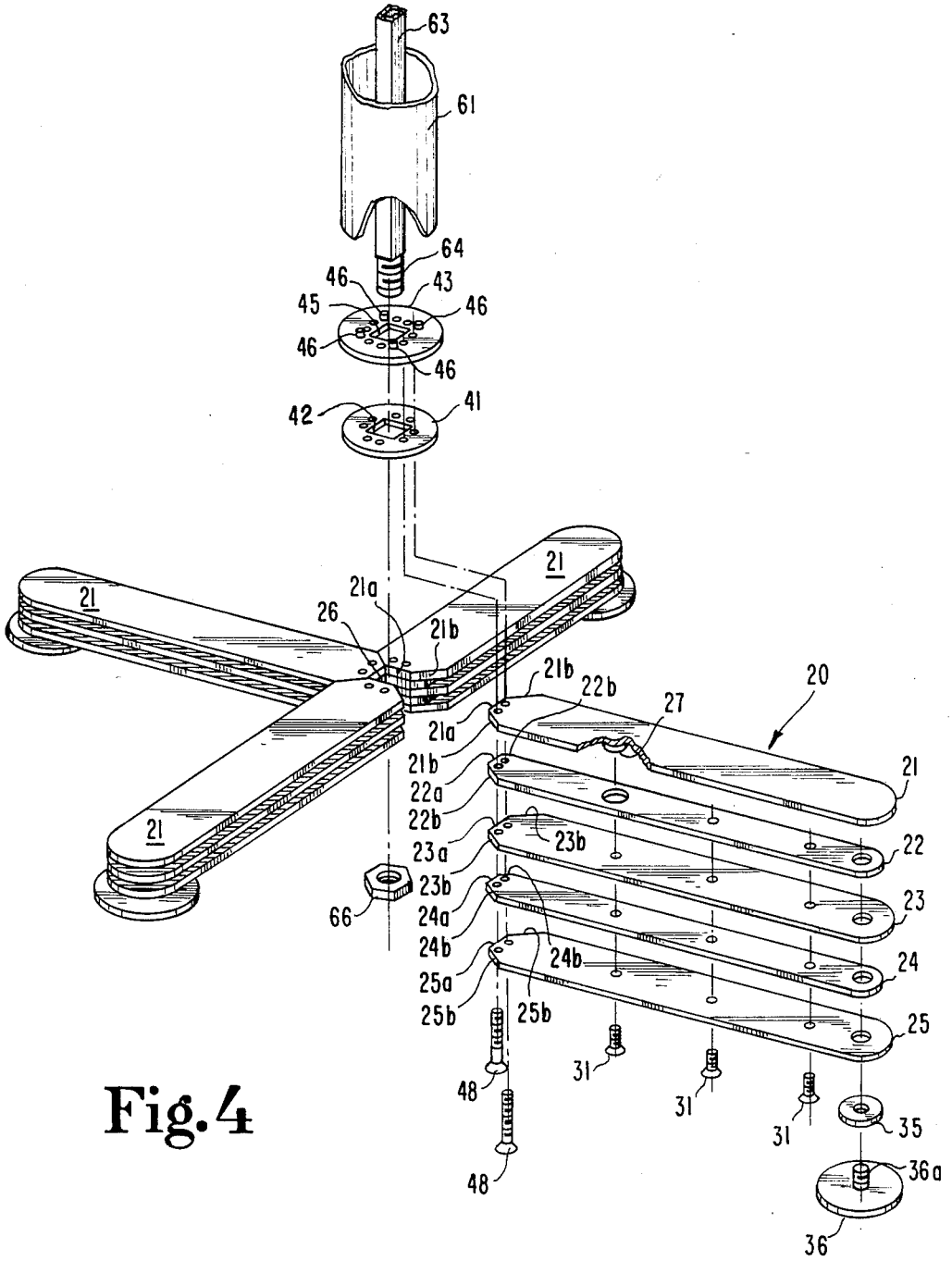
FIG. 4 is an exploded fragmentary view of the table base of FIG. 1.

The construction of leg assemblies 20 is further illustrated in the exploded view in FIG. 4. In this figure is illustrated how machine screws 31 are used to interconnect each of the metallic strips 21–25 comprising leg assembly 20. It is further shown how attachment screws 48 engage central attachment assembly 40 with each of the leg assemblies 20. In the preferred embodiment, two such attachment screws 48 are used for each leg assembly 20, as previously indicated.

Figure 3:
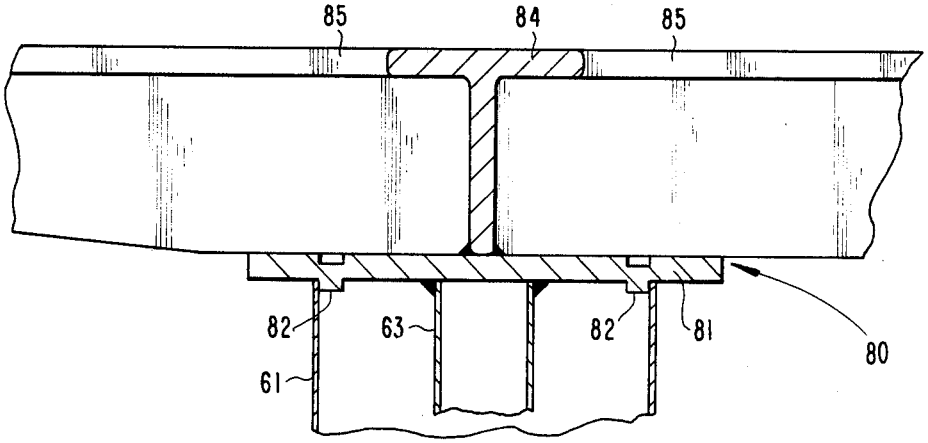
FIG. 3 is a side cross sectional view of the table base of FIG. 1 taken along section line 3—3 and viewed in the direction of the arrows as shown, showing the details of construction of the table top support.

Vertical standard assembly 60 comprises hollow column 61 and square center post 63 extending perpendicularly from central attachment assembly 40, as shown in FIGS. 2 and 4. Vertical standard assembly 60 provides support for support plate assembly 80, which in turn supports the table top or similar item, not shown in the figures. Support plate assembly 80, as illustrated in FIG. 3, includes cross flange 84 and lateral flanges 85 welded, in this embodiment, into an "X" configuration. Each of the flanges are provided with openings through which screws or bolts can be inserted to mount a table top. A top plate 81 is welded to the bottoms of cross flange 84 and lateral flanges 85. Top plate 81 includes locating posts 82 spaced at a radius around the top plate. Locating posts 82 are used to locate top plate 81 over hollow column 61, such that the interior circumferential surface of hollow column 61 fits snugly around a perimeter defined by the locating posts. Attachment washer 43 is provided with similar locating posts 46, shown in FIG. 2, so that hollow column 61 can be aligned over central attachment assembly 40. Locating posts 82 and 46 provide lateral restraint and support for hollow column 61 when it is interposed between support plate assembly 80 and central attachment assembly 40. When hollow column 61 is mounted between central attachment assembly 40 and support plate assembly 80, locating posts 46 and 82, as well as threaded openings 44 and attachment screws 48, are concealed from view in the normal use of table base assembly 10. Thus, the external appearance of the table base assembly remains smooth and aesthetically appealing.

Center post 63 is rigidly connected to the bottom surface of top plate 81, as shown in FIG. 3, and extends through the center of hollow column 61. In the preferred embodiment, post 63 is welded to plate 81, although other means of rigidly fastening these parts is contemplated by the invention, including connection in a knock-down construction. Center post 63 is square along its entire longitudinal length. However, as will become apparent from the following description, center post 63 need only have a square surface at the portion of the post that interfaces with central attachment assembly 40 and leg assemblies 20. Furthermore, in the preferred embodiment, center post 63 is illustrated as being hollow, while a solid center post may be used.

Returning to FIG. 2, center post 63 includes a welded dowel 64 affixed at the end of center post 63 distal from support plate assembly 80. A tension nut 66 is threaded onto welded dowel 64 to engage center post 63 with leg assemblies 20 when they are connected by central attachment assembly 40. Center post 63, welded dowel 64, and tension nut 66 can be tightened to draw support plate assembly 80 toward central attachment assembly 40, thereby compressing hollow column member 61. Thus, in this embodiment, center post 63 acts as a tension member while hollow column 61 operates as a compression member to provide stable vertical support for the table top mounted on support plate assembly 80.

In one embodiment of the present invention, column washer 41 and attachment washer 43 are provided with first and second square openings 42 and 45, respectively. Center post 63 extends through each of the square central openings. The dimensions of the square outer surface of center post 63 generally match the dimensions of the inner perimeter of square openings 42 and 45. Thus, center post 63 is prohibited from rotating relative to central attachment assembly 40. With this table base construction, no amount of motion of the table top during normal use can cause vertical standard assembly 60 to become disengaged from central attachment assembly 40, unless tension nu 66 is deliberately removed from the underside of the table base.

In another embodiment, the square central openings 42 and 45 are replaced or augmented by a square central opening formed by the juxtaposition of leg assemblies 20. Each of the metallic strips 21–25 of the leg assemblies 20 includes a free edge **21*a*–25*a*, respectively, at the inner end of each leg assembly, as best shown in FIG. 4. Flanking the free edge of each metallic strip is a pair of beveled edges 21b–25b, respectively. When each of the leg assemblies 20 are integrated by central attachment means 40, beveled edges 21b–25b of one leg assembly 20 abuts the complementary beveled edges of adjacent leg assemblies. Free edges 21a–25a for each leg assembly remain free and collectively form a square bore 26 aligned with first and second square openings 42 and 45. In this embodiment, center post 63 extends through square bore 26 so that the square outer surface of center post 63 acts against free edges 21a–25a of each leg assembly 20 to prevent rotation of the center post. In addition, when square central openings 42 and 45 in column and attachment washers 40 and 45, respectively, are included, center post 63 can act against free edges 21a–25a to prevent unwanted rotation of individual leg assemblies 20 relative to central attachment assembly 40**.

In the preferred embodiments, each of the components of table base assembly 10 are comprised of steel, or stainless steel; however, comparable materials may be substituted. The metallic strips 21–25 are also composed of solid steel. Each of the metallic strips for each leg assembly 20 can be plated or painted in any manner desired. For instance, the larger metallic strips 21, 23, and 25 can be nickel-chrome or chrome-plated or powder coated while the upper and lower spacers 22 and 24 can be coated with black lacquer. The aesthetic flexibility of the present invention is demonstrated by the fact that each of the metallic strips can be painted a different color, and the color scheme can vary between leg assemblies.

Although in the preferred embodiments the strips 21–25 are metallic, other materials are contemplated that have comparable strength and rigidity properties. The overlayed metallic strip construction of the present table base provides design and aesthetic flexibility, while also providing extra strength and rigidity for the legs of table base assembly 10. Additional strength and stability can be provided by welding the upper and lower spacers of each leg assembly together at the beveled edges to form a pair of crosses. In this instance, the welds are polished smooth on both sides of the spacer and care is taken to prevent the weld from entering the non-circular opening formed by the free edges of the spacers.

It is further apparent that the table base construction of the present invention is readily adapted for easy construction by the end user. The central attachment means 40 of the present invention is adapted to allow the end user to remove only one leg assembly and replace its metallic strips or rearrange or color-code the metallic strips comprising that leg assembly. With the interconnected metallic strip construction for each leg assembly, it is possible to individually treat or coat a selection of metallic strips for use by the end consumer in any manner desired by the end user.

The center post 63 of the present invention is illustrated as being square in the preferred embodiment. However, any non-circular outer surface of the center post is acceptable, provided that the openings 42 and 45 in column washer 41 and attachment washer 43, respectively, are complementary. If the central openings in the column and attachment washers are replaced or augmented by the bore 26 formed by the juxtaposition of the leg assemblies 20, then the free edges 21a–25a must be modified to provide a complementary inner circumference. It is also contemplated in the present invention to provide for more or fewer than the four legs shown in the preferred embodiment. In this instance, the dimensions of the free edges 21a–25a and the beveled edges 21b–25b must be modified commensurately to provide for the juxtaposed radial relation of each of the leg assemblies 20 Likewise, the outer surface of center post 63 must be modified accordingly.

It is seen from these details of the present table base construction that once the table base is assembled and tension nut 66 is firmly engaged on welded dowel 64, that the vertical standard assembly 60 cannot be disassembled or "unscrewed" from central attachment assembly 40 or the juxtaposed leg assemblies 20. With this table base construction, the only way that the table top can be removed is by unthreading tension nut 66 at the underside of table base assembly 10, and by lifting the table top and vertical standard assembly away from central attachment assembly 40. The table base construction of the present invention provides a stable and sturdy support for a table top or like item.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A table base comprising:

a plurality of leg elements, each having an inner end and a free surface at said inner end;

central attachment means for connecting each of said plurality of leg elements at said inner end in juxtaposed radial relation relative to each other so that said free surfaces form a non-circular opening when so connected;

a vertical standard having a portion extending through said non-circular opening, said portion having a complementary non-circular outer surface so that said outer surface acts against said free surfaces forming the non-circular opening to prevent rotation of said vertical standard with respect to said leg elements about a vertical axis passing through said opening; and wherein said central attachment means includes;

each of said leg elements having a number of bores therethrough at said inner ends;

an attachment washer having a central opening therethrough aligned with said non-circular opening and a plurality of threaded openings therethrough arranged in a pattern to align with said number of bores in each of said plurality of leg elements when said leg elements are in said juxtaposed radial relation; and a plurality of screws, each passing through each of said number of bores in each of said plurality of leg elements and engaged in a corresponding one of said plurality of threaded openings to secure said plurality of leg elements to said attachment washer; and wherein:

said portion of said vertical standard extends through said central opening in said attachment washer.

2. The table base of claim 1 wherein:

said attachment washer includes a flat surface; and said vertical standard includes a column mounted on said flat surface to conceal said plurality of threaded openings.

3. A table base comprising:

a plurality of leg elements, each having an inner end and a free surface at said inner end;

central attachment means for connecting each of said plurality of leg elements at said inner end in juxtaposed radial relation relative to each other so that said free surfaces form a non-circular opening when so connected;

a vertical standard having a portion extending through said non-circular opening, said portion having a complementary non-circular outer surface so that said outer surface acts against said free surfaces forming the non-circular opening to prevent rotation of said vertical standard with respect to said leg elements about a vertical axis passing through said opening; and wherein:

each of said plurality of leg elements comprises several overlayed elongated strips with means for removably interconnecting said several strips such that the strips comprising any one of said plurality of leg elements can be removed and replaced independently of the others of said plurality of leg elements; and each of said several strips includes a strip inner end corresponding to said inner end of one of said leg elements and a free edge at said strip inner end forming said free surface of one of said leg elements when said several strips are interconnected.

4. A table base comprising:

a plurality of leg assemblies, each comprising several overlayed elongated strips with means for removably interconnecting said several strips, each of said strips having an inner end;

central attachment means for connecting each of said plurality of leg assemblies at said inner ends in juxtaposed radial relation relative to each other such that the strips comprising any of said plurality of leg assemblies can be independently removed and replaced; and wherein:

each of said elongated strips includes a number of bores therethrough at said inner end, said number of bores being aligned when each of said number of strips in one of said plurality of leg assemblies are overlayed; and said central attachment means includes;

an attachment washer having a plurality of threaded openings therethrough arranged in a pattern to align with said aligned number of openings in each of said plurality of leg assemblies when said leg assemblies are in juxtaposed radial relation; and a plurality of screws, each extending through each of said aligned number of bores and engaged in a corresponding one of said plurality of threaded openings.

5. The table base of claim 4, wherein:

said several strips includes a top strip and a bottom strip and a number of intermediate strips therebetween; and said means for removably interconnecting said strips includes;

said number of intermediate strips having several first spaced openings therethrough;

said top strip having several threaded bosses projecting therefrom through said several spaced openings and toward said bottom strip;

said bottom strip having several second openings therethrough aligned with said several first openings; and several screws extending through each of said several first and second openings and engaged in a corresponding one of said several threaded bosses.

6. A table base comprising:

a table top mounting plate;

a base member for resting on the floor in a stable fashion;

a vertical hollow column between said mounting plate and said base member;

tension and interlocking means, including a tension rod extending through said vertical hollow column and containing a non-circular interlocking portion, for compressing said vertical hollow column between said mounting plate and said base member and for preventing rotation of said mounting plate with respect to said base member; wherein said tension and interlocking means includes:

an interlocking washer coupled with said base member and having a central non-circular opening therethrough; and wherein said tension rod is affixed to said table top mounting plate and said non-circular interlocking portion of said rod extends through said central non-circular opening and cooperates with said central non-circular opening to prevent said rotation.

7. The table base according to claim 6, wherein:

said interlocking portion is at one end of said tension rod, said one end further including a threaded portion;

the other end of said rod is welded to said table top mounting plate; and said tension and interlocking means further includes a threaded nut for engaging said threaded portion of said rod, said nut acting against said base member, wherein as said nut is threaded onto said threaded portion, said rod is put in tension and said hollow column is compressed between said mounting plate and said base member.

8. The table base according to claim 6, wherein:

said interlocking washer includes a support surface having several first locating posts projecting therefrom;

said hollow column is supported on said support surface and includes an interior circumferential surface;

said several first locating posts project into said hollow column and are arranged on said support surface to abut the inner circumferential surface of said hollow column to locate said column on said support surface; and said table top mounting plate includes several second locating posts projecting therefrom into said hollow column, said second locating posts arranged on said mounting plate to abut the inner circumferential surface of said hollow column to locate said mounting plate on said hollow column.

9. The table base according to claim 7, wherein: said base member includes a plurality of legs, each having an inner end, and said tension and interlocking means includes; and means for interconnecting said plurality of legs at said inner ends such that said inner ends form a non-circular bore aligned with said central non-circular opening in said interlocking washer;

wherein said non-circular interlocking portion of said tension rod extends through said non-circular bore and cooperates with said non-circular bore to prevent said rotation; and wherein said nut acts against said plurality of legs when said legs are interconnected.

10. The table base according to claim 9, wherein said means for interconnecting said plurality of legs includes:

each of said plurality of legs having a number of openings therethrough at said inner end;

said interlocking washer further having a plurality of threaded openings arranged in a pattern to align with said number of openings in each of said plurality of legs when said legs are interconnected; and a plurality of screws, each extending through each of said number of bores and engaged in a corresponding one of said plurality of threaded openings.

11. A table base comprising:

a table top mounting plate;

a base member for resting on the floor in a stable fashion;

a vertical hollow column between said mounting plate and said base member;

tension and interlocking means, including a tension rod extending through said vertical hollow column and containing a non-circular interlocking portion, for compressing said vertical hollow column between said mounting plate and said base member and for preventing rotation of said mounting plate with respect to said base member; and wherein:

said base member includes a plurality of legs, each having an inner end, and said tension and interlocking means includes;

means for interconnecting said plurality of legs at said inner ends such that said inner ends form a non-circular bore; and wherein said non-circular interlocking portion of said tension rod extends through said non-circular bore and cooperates with said non-circular bore to prevent said rotation.

12. The table base according to claim 11, wherein said means for interconnecting said plurality of legs includes:

each of said plurality of legs having a number of openings therethrough at said inner end;

an attachment washer having a central opening therethrough aligned with said non-circular bore to receive said rod therethrough, and further having a plurality of threaded openings arranged in a pattern to align with said number of openings in each of said plurality of legs when said legs are interconnected; and a plurality of screws, each extending through each of said number of bores and engaged in a corresponding one of said plurality of threaded openings.

* * * * *

UNITED STATES PATENT AND TRADEMARK OFFICE

CERTIFICATE OF CORRECTION

PATENT NO. : 4,789,122

DATED : December 6, 1988

INVENTOR(S) : David R. Gutgsell

It is certified that error appears in the above-identified patent and that said Letters Patent is hereby corrected as shown below:

Title page:

In the Abstract, at line 10, after the word "leg", please insert --assemblies--.

In the Abstract, at line 12, "legs" should read --leg assemblies-

In column 3, at line 26, "into o out" should read --into or out--.

In column 4, at line 62, "tension nu 66" should read --tension nut 66--.

Signed and Sealed this

Second Day of May, 1989

*Attest:*

*Attesting Officer*

DONALD J. QUIGG

*Commissioner of Patents and Trademarks*